US006568051B2

(12) United States Patent
Legl et al.

(10) Patent No.: US 6,568,051 B2
(45) Date of Patent: May 27, 2003

(54) APPARATUS FOR NEEDLING A NON-WOVEN MATERIAL

(75) Inventors: Ludwig Legl, Buchkirchen (AT); Robert Strasser, Langenstein (AT); Andreas Plump, St. Georgen (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 0 days.

(21) Appl. No.: 10/271,192

(22) Filed: Oct. 15, 2002

(65) Prior Publication Data

US 2003/0074773 A1 Apr. 24, 2003

(30) Foreign Application Priority Data

Oct. 23, 2001 (AT) ..... 1683/2001

(51) Int. Cl.[7] ..... D04H 18/00
(52) U.S. Cl. ..... 28/114
(58) Field of Search ..... 28/107, 108, 109, 28/110, 111, 112, 113, 114, 115; 112/80.4, 80.45, 80.42, 80.41

(56) References Cited

U.S. PATENT DOCUMENTS

| | | | | | |
|---|---|---|---|---|---|
| 4,777,706 | A | * | 10/1988 | Stanislaw | 28/113 |
| 4,891,870 | A | * | 1/1990 | Muller | 28/107 |
| 5,390,556 | A | * | 2/1995 | Nencini et al. | 28/113 |
| 5,568,678 | A | * | 10/1996 | Fehrer | 28/115 |
| 5,732,453 | A | * | 3/1998 | Dilo et al. | 28/114 |
| 6,000,112 | A | * | 12/1999 | Ollinger et al. | 28/114 |
| 6,161,269 | A | * | 12/2000 | Dilo et al. | 28/114 |
| 6,266,856 | B1 | * | 7/2001 | Fehrer et al. | 28/114 |
| 6,481,071 | B1 | * | 11/2002 | Fehrer et al. | 28/107 |

FOREIGN PATENT DOCUMENTS

| | | |
|---|---|---|
| DE | 196 15 697 | 3/1997 |
| EP | 0 892 102 | 5/1998 |

* cited by examiner

*Primary Examiner*—Amy B. Vanatta
(74) *Attorney, Agent, or Firm*—Collard & Roe, P.C.

(57) ABSTRACT

An apparatus is described for needling a non-woven material with a support (1) receiving at least one needleboard (3), which support is drivable in a reciprocating fashion both in the needle-penetration direction (5) as well as the direction of passage (6) of the non-woven material and on which are coupled the connecting rods (9, 10) of two oppositely drivable eccentric drives (7, 8) for the drive in the needle-penetration direction (5) and on which acts at least one additional eccentric drive (7, 8), and with a device for setting the movement component of the support in the direction of passage (6) of the non-woven material. In order to provide advantageous constructional conditions it is proposed that the connecting rods (9, 10) of the two oppositely drivable eccentric drives (7, 8) extend inclined in an opposite direction with respect to the needle-penetration direction (5), that the additional eccentric drive (7 or 8) revolves synchronously with one of the two other eccentric drives (7, 8), that the connecting rod (9 or 10) of the additional eccentric drive (7 or 8) which is also articulated on the support (1) forms a parallelogram of links with the connecting rod (9 or 10) of the synchronously revolving eccentric drive (7 or 8) for the purpose of guiding the support (1) and that the oppositely drivable eccentric drives (7, 8) are drivable through separate motors (18) which are adjustable with respect to their mutual rotational angle position through a control device (19).

4 Claims, 3 Drawing Sheets

APPARATUS FOR NEEDLING A NON-WOVEN MATERIAL

FIELD OF THE INVENTION

The invention relates to an apparatus for needling a non-woven material with a support receiving at least one needleboard, which support is drivable in a reciprocating fashion both in the needle-penetration direction as well as the direction of passage of the non-woven material and on which are coupled the connecting rods of two oppositely driven eccentric drives for the drive in the needle-penetration direction, and with a device for setting the movement component of the support in the direction of passage of the non-woven material.

DESCRIPTION OF THE PRIOR ART

In order to reduce the draft of a non-woven material drawn continuously by a needling apparatus on the one hand and to increase the advance of the non-woven material on the other hand it is known (DE 196 15 697 A1) to provide an additional eccentric drive for a needleboard movement in the direction of passage of the non-woven material in addition to the needleboard drive reciprocating in the needle-penetration direction, so that due to the movement component of the needles in the direction of passage of the non-woven material the tensile load of the nonwoven material as occurs during the needle penetration is reduced or the advance of the non-woven material is increased accordingly. In order to set the oscillating amplitude of the needleboard in the direction of passage of the non-woven material, it has already been proposed in this connection (EP 0 892 102 A2) to equip the additional needleboard drive with two parallel eccentric shafts whose connecting rods are mutually connected by a coupler linked to a support for the needleboard. By making a respective choice of the mutual angular position of the two eccentric shafts it is possible to set the needleboard advance in the direction of passage of the non-woven material. This simple possibility for adjustment is gained with the disadvantage that the support which is coupled with the connecting rods of the two eccentric drives for the needleboard drive in the needle-penetration direction performs a reciprocating swiveling movement which produces a respective swiveling movement of the needles in the non-woven material during the needle penetration.

SUMMARY OF THE INVENTION

The invention is thus based on the object of providing an apparatus for needling a non-woven material of the kind mentioned above in such a way that advantageous conditions are provided on the one hand for a construction of a needleboard drive of low complexity both in the needle-penetration direction as well as in the direction of passage of the non-woven material and on the other hand for a simple setting of the needleboard advance in the direction of passage of the non-woven material without having to swivel the needleboard.

This object is achieved by the invention in such a way that the connecting rods of the two oppositely driven eccentric drives extend in opposite directions with respect to the needle-penetration direction, that the additional eccentric drive revolves synchronously with one of the two other eccentric drives, that the connecting rod of the additional eccentric drive which is also coupled with the support forms a parallelogram of links for guiding the support with the connecting rod of the synchronously revolving eccentric drive, and that the oppositely drivable eccentric drives are provided with separate motors which are adjustable with respect to their mutual rotational angle position via a control device.

Since the connecting rods of the two oppositely drivable eccentric drives for the needleboard drive in the needle-penetration direction are not provided, as is otherwise usual, with a central position extending in the needle-penetration direction but extend inclined in opposite directions with respect to the needle-penetration direction, the support for the needleboard can be driven along an inherently closed trajectory by a phase shift between said two eccentric drives, which allows an advantageous adjustment of the needle movement to the advancement of the non-woven material when the support is guided parallel with respect to itself. For this purpose the connecting rod of the additional eccentric drive forms a parallelogram of links with the connecting rod of the synchronously revolving eccentric drive of the two other eccentric drives, which ensures the parallel guidance of the support and thus a swivel-free needle penetration into the non-woven material. Since already a comparatively small mutual offset of the angular position of the two eccentric drives revolving in opposite directions will produce a curved path for the support with a respective component in the direction of passage of the non-woven material, the horizontal component of the needleboard drive can be adjusted in a sensitive way to the respective conditions via the phase shift of the oppositely driven eccentric drives, namely with a relatively low amount of constructional effort when the mutually oppositely driven eccentric drives are driven via separate motors which with respect to their mutual rotional angle position are adjustable through a control device. As a result, only a control intervention is thus necessary in order to change the rotational angle position of one of the motors with respect to the other motor in order to enable the setting of the needboard advance in the direction of passage of the non-woven material, which naturally can also be performed during the needling process.

Although an additional eccentric drive is sufficient for the parallel guidance of the support, particularly simple constructional conditions are obtained with respect to the balancing of masses when two additional eccentric drives are provided which revolve synchronously with one each of the two other eccentric drives and form a parallelogram of links each with the same. In this case, the eccentric drives forming a parallelogram of links each for guiding the support can be drivably connected and be driven via a motor each. Another possibility is assigning each eccentric drive with a separate motor which is controllable with respect to speed and rotational angle position, which means drive motors with coinciding speed and rotational angle position for the eccentric drives forming a parallelogram of links.

BRIEF DESCRIPTION OF THE DRAWINGS

The subject matter of the invention is shown by way of examples in the drawings, wherein.

DESCRIPTION OF THE PREFERRED EMBODIMENT

Figure 1:
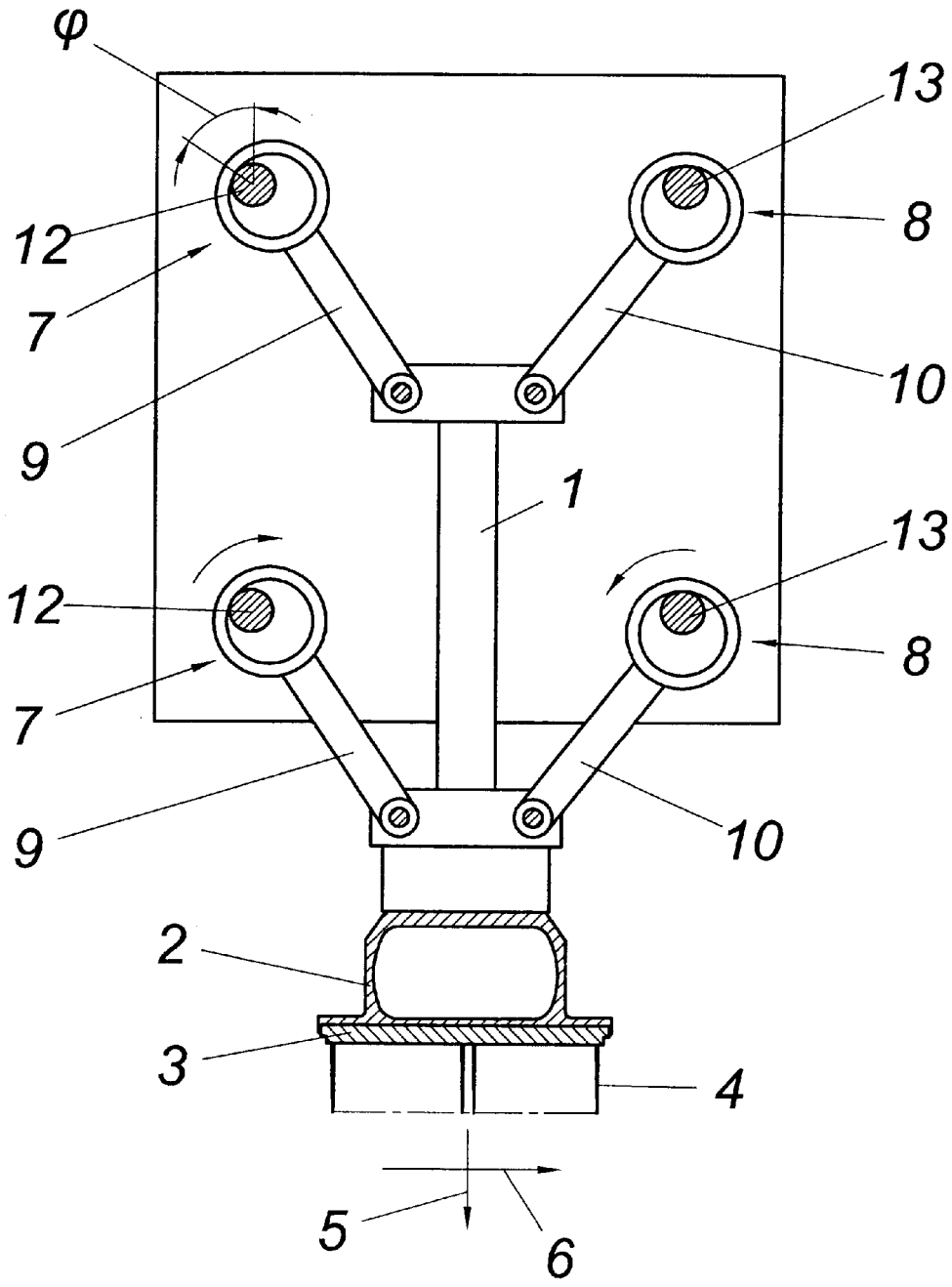
FIG. 1 shows an apparatus in accordance with the invention for needling a non-woven material in sections in a schematic longitudinal view.

As is shown in particular in FIG. 1, the needling apparatus comprises a support 1 for the needleboard 3 which is exchangeably held in a needle beam 2, which needleboard 3 is reciprocatingly driven with its needles 4 both in the needle penetration direction 5 as well as in the direction of passage of the non-woven material 6. For this purpose two pairs of eccentric drives 7 and 8 are provided whose connecting rods 9 and 10 are articulated on support 1. The arrangement is made in such a way that the eccentric drives 7 on the one hand and the eccentric drives 8 on the other hand each form a parallelogram of links for guiding the support 1, which thus can be displaced merely parallel to itself. If the eccentric drives 7 and 8 are driven without any mutual phase shifting, the support 1 is exclusively driven reciprocatingly in the needle penetration direction 5, namely with a stroke corresponding approximately to twice the eccentricity of the eccentric drives 7, 8. If on the other hand one of the eccentric drives 7 and 8 as arranged in pairs are twisted with respect to the respective other eccentric drive by a phase angle $\phi$, the support 1 is reciprocatingly driven not only in the needle penetration direction 5 but also in the direction of passage 6 of the non-woven material. The needles 4 move along a trajectory whose form depends not only on the phase shift $\phi$, but also on the dimension of the eccentricity of the eccentric drives 7 and 8, the length of the connecting rods 9 and 10 and the inclination of the middle connecting rod position with respect to the needle-penetration direction 5.

Figure 2:
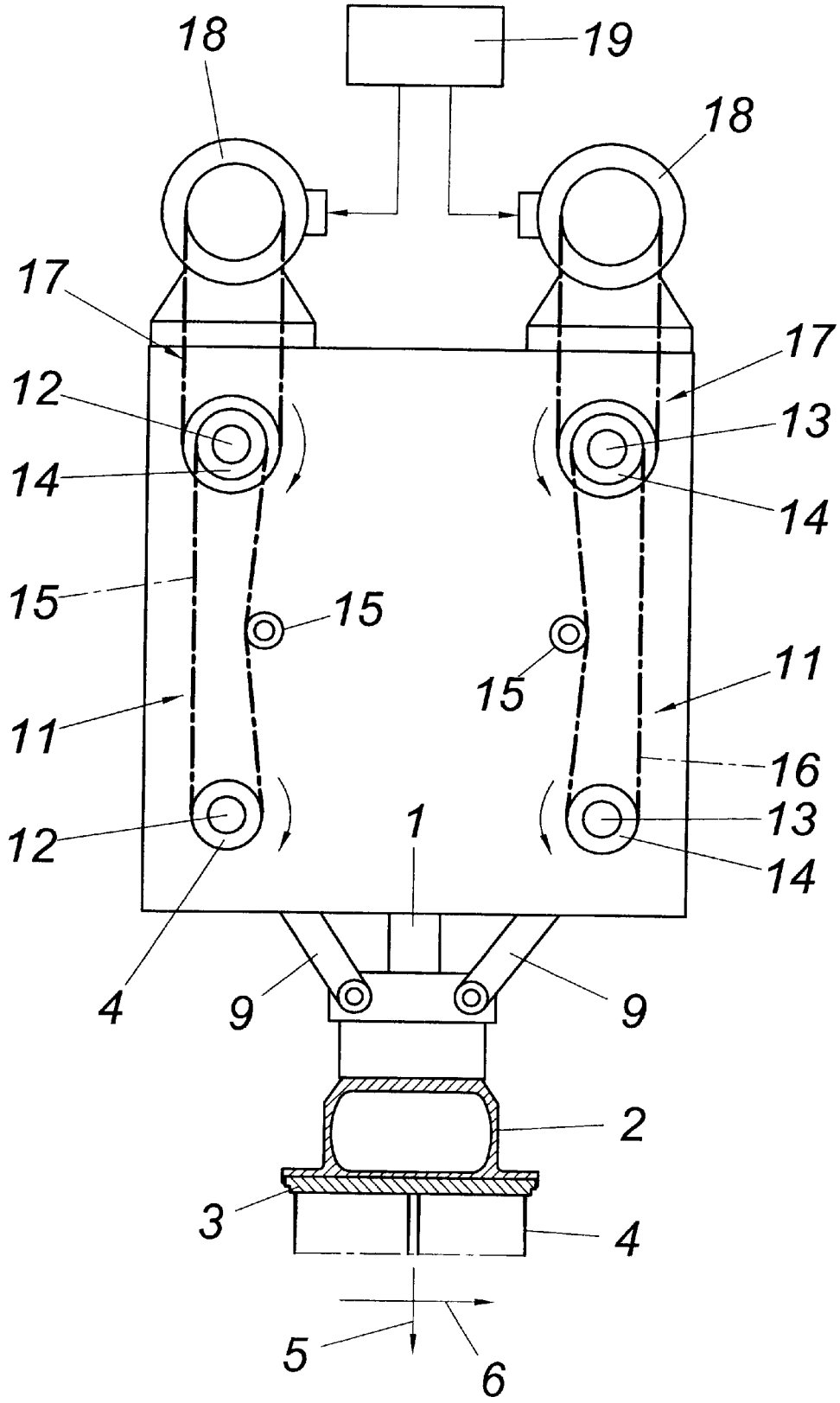
FIG. 2 shows the apparatus according to FIG. 1 in a schematic side view.

In order to enable setting the phase angle $\phi$ between the eccentric drives 7 and 8, the eccentric drives 7 and 8 which each form a parallelogram of links are each connected according to FIG. 2 via a toothed belt drive 11 which consists of toothed belt pulleys 14 situated on the eccentric shafts 12 and 13 and a toothed belt 16 which is guided over a tension roller 15. One of the two eccentric shafts 12 and 13 is each connected via a belt drive 17 with a separate motor 18, so that the eccentric drives 7 and 8 which each form a guide parallelogram for the support 1 can be driven separately from each other. Since the motors 18 are triggered via a control device 19 concerning the speed and the rotational angle position, a synchronous run of the eccentric drives 7 and 8 can be ensured through said individual drives, namely with a rotational angle position which is different according to the phase angle $\phi$. The adjustment of the phase angle $\phi$ between the eccentric drives 7 and 8 can thus be performed according to the respective requirements through a respective triggering of the motors 18 via the control device 19 during the needling operation.

Figure 3:
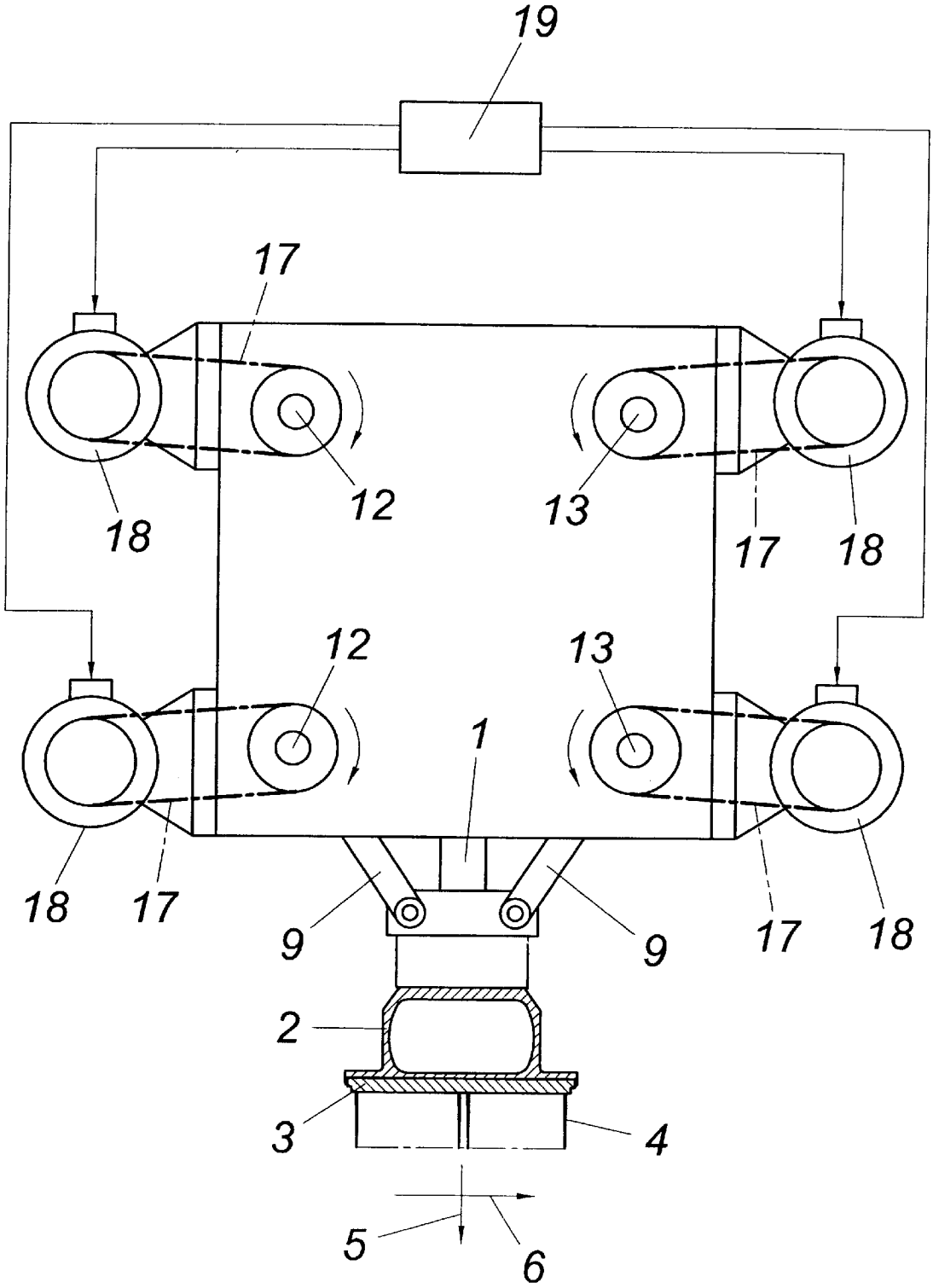
FIG. 3 shows a view corresponding to FIG. 2 of an embodiment of an apparatus in accordance with the invention for needling a non-woven material.

In contrast to the embodiment according to FIG. 2, the construction according to FIG. 3 shows individual drives for all eccentric drives 7 and 8, with the motors 18 which are arranged in pairs again being in drive connection with the eccentric shafts 12, 13 through toothed belt drives 17. It must be ensured through the control device 19 that motors 18 which are associated on the one hand to the eccentric shafts 12 and on the other hand to the eccentric shafts 13 are provided in pairs with the same speed and same rotational angle position, so that for setting the needle movement in the direction of passage 6 of the non-woven material only a different rotational angle position is obtained between the motors 18 arranged in pairs so as to enable the driving of the eccentric drives 7 and 8 under a phase angle $\phi$.

It is understood that the represented embodiments do not limit the inventive idea because it is irrelevant for the invention how the drive connection between the motors 18 and the eccentric shafts 12, 13 is solved from a constructional point of view when a respective freedom from slip is ensured.

What is claimed is:

1. An apparatus for needling a non-woven material with a support receiving at least one needleboard, which support is drivable in a reciprocating fashion both in the needle-penetration direction as well as the direction of passage of the non-woven material and on which are coupled connecting rods of two oppositely drivable eccentric drives for the drive in the needle-penetration direction and on which acts at least one additional eccentric drive, and with a device for setting the movement component of the support in the direction of passage of the non-woven material, characterized in that the connecting rods (9, 10) of the two oppositely drivable eccentric drives (7, 8) extend inclined in an opposite direction with respect to the needle-penetration direction (5), that the additional eccentric drive (7 or 8) revolves synchronously with one of the two other eccentric drives (7, 8), that the connecting rod (9 or 10) of the additional eccentric drive (7 or 8) which is also articulated on the support (1) forms a parallelogram of links with the connecting rod (9 or 10) of the synchronously revolving eccentric drive (7 or 8) for the purpose of guiding the support (1) and that the oppositely drivable eccentric drives (7, 8) are drivable through separate motors (18) which are adjustable with respect to their mutual rotational angle position through a control device (19).

2. An apparatus as claimed in claim 1, characterized in that two additional eccentric drives (7, 8) are provided which revolve synchronously with one each of the two other eccentric drives (7, 8) and form with the same a parallelogram of links each.

3. An apparatus as claimed in claim 2, characterized in that the eccentric drives (7 or 8) which each form a parallelogram of links are drivably connected and can be driven through a motor (18) each.

4. An apparatus as claimed in claim 1, characterized in that each eccentric drive (7, 8) is associated with a separate motor (18) which can be triggered with respect to speed and rotational angle position.

* * * * *